United States Patent [19]

Benge et al.

[11] 4,123,303

[45] Oct. 31, 1978

[54] IGNITABLE COMPOSITIONS

[75] Inventors: Robert J. Benge, Waltham Abbey; Cecil H. Miller, Woodford Green, both of England

[73] Assignee: Ministry of Technology in Her Britannic Majesty's Government of the United Kingdom of Great Britain and Northern Ireland, London, England

[21] Appl. No.: 73,649

[22] Filed: Sep. 18, 1970

[30] Foreign Application Priority Data

Sep. 19, 1969 [GB] United Kingdom ..... 46393/69

[51] Int. Cl.[2] ..... C06B 45/04

[52] U.S. Cl. ..... 149/17; 149/22; 149/37; 149/114

[58] Field of Search ..... 149/22, 37, 109, 5, 149/17, 87, 114

[56] References Cited

U.S. PATENT DOCUMENTS

| | | | |
|---|---|---|---|
| 3,084,181 | 4/1963 | D'Alelio | 149/109 X |
| 3,118,798 | 1/1964 | Winckler | 149/37 X |
| 3,173,367 | 3/1965 | Shinpaugh | 149/22 X |
| 3,254,996 | 6/1966 | MacDonald | 149/37 X |

*Primary Examiner*—Peter A. Nelson

*Attorney, Agent, or Firm*—Cushman, Darby & Cushman

[57] ABSTRACT

A process for the preparation of an explosive delay composition consisting substantially of barium chromate and one or more fuels wherein the barium chromate is co-precipitated from solution at an elevated temperature in the presence of a suspension of fuel in a finely divided form so that the fuel is substantially incorporated in the barium chromate crystal or aggregate of crystals.

7 Claims, No Drawings

IGNITABLE COMPOSITIONS

This invention relates to novel explosive delay compositions and methods of making them.

Delay compositions are well-known means of introducing a controlled delay time between the initiation and the burning or explosion of an explosive charge. Such compositions are desirably free-flowing powders substantially unaffected by atmospheric conditions, such as humidity, with a pre-determined uniform rate of burning which is relatively constant on ageing.

Hitherto, such compositions have consisted of a mechanical mixture of an oxidant and metal fuel and have the disadvantages that segregation and/or oxidation of the fuel may occur on storage giving variable burning times and rates. Such variability in fuzes may lead to premature ignition or explosion.

It has now been found that delay compositions may be prepared without the above disadvantages by co-precipitating barium chromate in the presence of a fine suspension of the fuel so that the fuel is substantially incorporated in the barium chromate crystal or aggregate of crystals.

According to the invention, there is provided a process for the preparation of an explosive delay composition consisting substantially of barium chromate and one or more fuels, comprising co-precipitating barium chromate from solution at an elevated temperature in the presence of a suspension of the fuel in a finely divided form whereby the fuel is substantially incorporated in the barium chromate crystal or aggregate of crystals.

The fuel consists of one or more of the elements boron, silicon, titanium, tantalum, niobium, antimony or zirconium, preferably boron and/or titanium. Preferably, the fuel is not greater than 10 microns in size but particles up to about 60 microns may be used when a coarse delay composition is required.

The process of the invention is conveniently carried out by the double decomposition of two or more water-soluble salts in the presence of a suspension of the fuel to give a relatively insoluble product. Thus, for instance an aqueous barium chloride solution may be reacted with an aqueous sodium dichromate solution in the presence of a suspension of boron to give an insoluble barium chromate/boron crystalline product.

The particle size of the product may be controlled by adjusting the pH of the reactant solution. This may conveniently be carried out by using as reactants two barium salts, one derived from a strong acid and the other derived from a weak acid. For instance, it has been found that the use of barium chloride as the sole source of barium produced the coarsest materials. The use of barium chloride and barium acetate in molar ratios of 9.5 or more to 1 respectively produced a free-flowing product most of which passed a 350 mesh B.S. sieve, and with molar ratios of less than 9.5 to 1, the free-flowing properties were reduced.

At any given fuel content, the rate of burning of the product is not affected by the overall granule or crystal size. The burning rate of the product may be varied by varying the size and/or proportion of the fuel, by the incorporation of more than one of the desired elements as the fuel, or by a combination of all these variables. Typical burning rates may be varied from about 0.25 to about 4 seconds per centimeter length of product.

These burning times are more consistent and faster than corresponding mixtures produced by known mechanical mixing due to the very close and intimate contact of the fuel and the oxidant, the absence of segregation and the protection given to the fuel against surface oxidation.

The invention is illustrated, by way of wxample, to the preparation of compositions containing barium chromate.

EXAMPLE 1

21 grammes of amorphous boron of mean particle diameter 0.7 microns was suspended in three liters of molar barium chloride solution heated to 95° C. and stirred while three liters of sodium dichromate solution, 300 grammes per liter, was added in ten minutes, the temperature being maintained at 90°–95° C. After settling, decanting the mother liquor, washing by decantation four times with distilled water, filtering and drying, 600 grammes of a free-flowing powder was recovered of which 18% was retained by a 300 mesh B.S. sieve, 23% by a 350 mesh B.S. sieve. This material had a burning rate, when pressed at 278 M.N./m$^2$ into stainless steel tubes 0.5 cm diameter, of 3.0 sec/cm.

EXAMPLE 2

22 grammes of amorphous boron of mean particle diameter 0.7 micron was suspended in 2.75 liters of barium chloride solution (molar) mixed with 0.25 liters of barium acetate solution (molar) and three liters of sodium dichromate solution, 300 grammes/liter added following the procedure described in Example I. 644 grammes of a free-flowing product was obtained of which 639 grammes passed a 350 mesh B.S. sieve and the burning rate of which was 3.0 sec/cm.

EXAMPLE 3

21 grammes of amorphous boron of mean particle diameter 1.2 micron was suspended in 2.775 liters of molar barium chloride solution and 0.225 liters of molar barium acetate solution, and 3 liters of sodium dichromate solution, 300 grammes/liter, added following the procedure described in Example 1. 650 grammes of a free-flowing product was obtained of which 640 grammes passed a 350 mesh B.S. sieve and with a burning rate of 2.9 sec./cm.

EXAMPLE 4

17.15 grammes of titanium (through 350 mesh B.S. sieve) was suspended in 0.2 liters of molar barium chloride solution heated to 95° C. and stirred while 0.2 liters of sodium dichromate solution was added in ten minutes, the temperature being kept at 90°–95° C. After decanting, washing and drying, 54.2 grammes of a free-flowing powder was recovered with a burning rate of 0.35 sec./cm.

EXAMPLE 5

151 grammes of boron of mean particle diameter 0.7 micron was suspended in 16.425 liters of molar barium chloride solution mixed with 1.575 liters of molar barium acetate solution and 18 liters of sodium dichromate solution (300 grammes/liter) added in 13½ minutes with stirring, the temperature being maintained at 90°–95° C. After settling, decanting the mother liquor, washing four times by stirring with 30 liters of distilled water, filtering and drying, 3950 grammes of a free flowing product was obtained of which 98 percent passed a 350 mesh B.S. sieve. The mean burning rates of three samples of this material were 2.20, 2.19 and 2.22 sec./cm.

What I claim is:

1. A process for the preparation of an explosive delay composition consisting substantially of barium chromate and at least one solid fuel selected from the group consisting of boron, silicon, titanium, tantalum, niobium, antimony and zirconium, comprising suspending the solid fuel in finely divided form in an aqueous medium and reacting in the aqueous medium at elevated temperature a water-soluble chromate with a water-soluble barium compound to thereby precipitate the fuel particles by substantial incorporation of the particles in insoluble barium chromate.

2. A process according to claim 1 wherein the particle size of the product is controlled by adjustment of the pH of the reactant solution.

3. A process according to claim 1 wherein the fuel consists of at least one element selected from the group consisting of boron and titanium.

4. A process according to claim 1 wherein the fuel is of particle size not greater than 60 microns.

5. A process according to claim 4 wherein the fuel is of particle size not greater than 10 microns.

6. A process according to claim 1 wherein the coprecipitation comprises a double decomposition of at least two water-soluble salts in the presence of a suspension of the fuel to give a relatively insoluble product.

7. A process according to claim 6 wherein an aqueous barium chloride solution is reacted with an aqueous sodium dichromate solution in the presence of a suspension of boron.

* * * * *